US005390686A

United States Patent [19]

Lin et al.

[11] Patent Number: 5,390,686

[45] Date of Patent: Feb. 21, 1995

[54] MULTIPLE-FOLD AUTOMATIC UMBRELLA

[76] Inventors: Chung-Kuang Lin; Jung-Jen Chang, both of No. 16, Chen Tai Road, Sec. 3, Wu Ku Hsiang, Taipei Hsien, Taiwan, Prov. of China

[21] Appl. No.: 148,621

[22] Filed: Nov. 8, 1993

[51] Int. Cl.[6] ..... A45B 25/14

[52] U.S. Cl. ..... 135/24; 135/20.3; 135/25.1

[58] Field of Search ..... 135/20.3, 22, 24 OR, 135/25.1, 25.34, 38

[56] References Cited

U.S. PATENT DOCUMENTS

| | | | |
|---|---|---|---|
| 3,658,076 | 4/1972 | Yasuda | 135/24 X |
| 3,687,146 | 8/1972 | Seitel | 135/24 X |
| 4,548,222 | 10/1985 | Day | 135/24 OR |
| 4,941,494 | 7/1990 | Wu | 135/24 |
| 5,060,684 | 10/1991 | Wu | 135/24 X |
| 5,078,165 | 1/1992 | Wu | 135/24 OR |
| 5,144,969 | 9/1992 | Chou et al. | 135/24 X |
| 5,161,562 | 11/1992 | Wu | 135/20.3 OR |
| 5,178,174 | 1/1993 | Wu | 135/22 OR |
| 5,267,583 | 12/1993 | Wu | 135/20.3 X |

*Primary Examiner*—Carl D. Friedman
*Assistant Examiner*—Wynn E. Wood

[57] ABSTRACT

An automatic umbrella includes: a central shaft, a rib assembly for securing an umbrella cloth thereon, an opening spring for resiliently opening the umbrella, a plurality of closing springs for resiliently closing the umbrella, and a control device for controlling the opening or closing of the umbrella by depressing an upper portion or a lower portion of a seesaw button of the control device, the central shaft having a plurality of telescopic tubes telescopically retractible with one another and the rib assembly having a plurality of ribs, which can be folded to greatly shorten a total length of a closed umbrella adapted for convenient carrying or storing purposes.

6 Claims, 4 Drawing Sheets

MULTIPLE-FOLD AUTOMATIC UMBRELLA

BACKGROUND OF THE INVENTION

U.S. Pat. No. 4,941,494 entitled "Lightly-operating Automatic Umbrella for Preventing False Operation" disclosed an automatic umbrella having a control device, by which upon depressing an upper lever 511 of a seesaw button 51, an extension (opening) controller 52 is actuated for opening the umbrella; and upon depressing a lower lever 512, a retraction (closing) controller 53 is actuated for closing the umbrella. However, such a conventional automatic umbrella is suitable for two-fold automatic umbrella. After folding the ribs 2 and the shafts 14, 11 to be a retracted or folded umbrella, it still occupies a space without greatly reducing its volume, thereby being inconvenient for carrying purpose.

Therefore, a multiple-fold, especially triple-fold, automatic umbrella is invented by the present inventors.

SUMMARY OF THE INVENTION

The object of the present invention is to provide an automatic umbrella including: a central shaft, a rib assembly for securing an umbrella cloth thereon, an opening spring having been stored the elastic energy for opening the umbrella, a plurality of closing springs with their pre-stored elastic energy for closing the umbrella, and a control device for controlling the opening or closing of the umbrella by depressing an upper portion or a lower portion of a seesaw button of the control device, the central shaft having a plurality of telescopic tubes telescopically retractible with one another and the rib assembly having a plurality of ribs, which can be folded to greatly shorten a total length of a closed umbrella adapted for convenient carrying or storing purposes.

DETAILED DESCRIPTION

Figure 1:
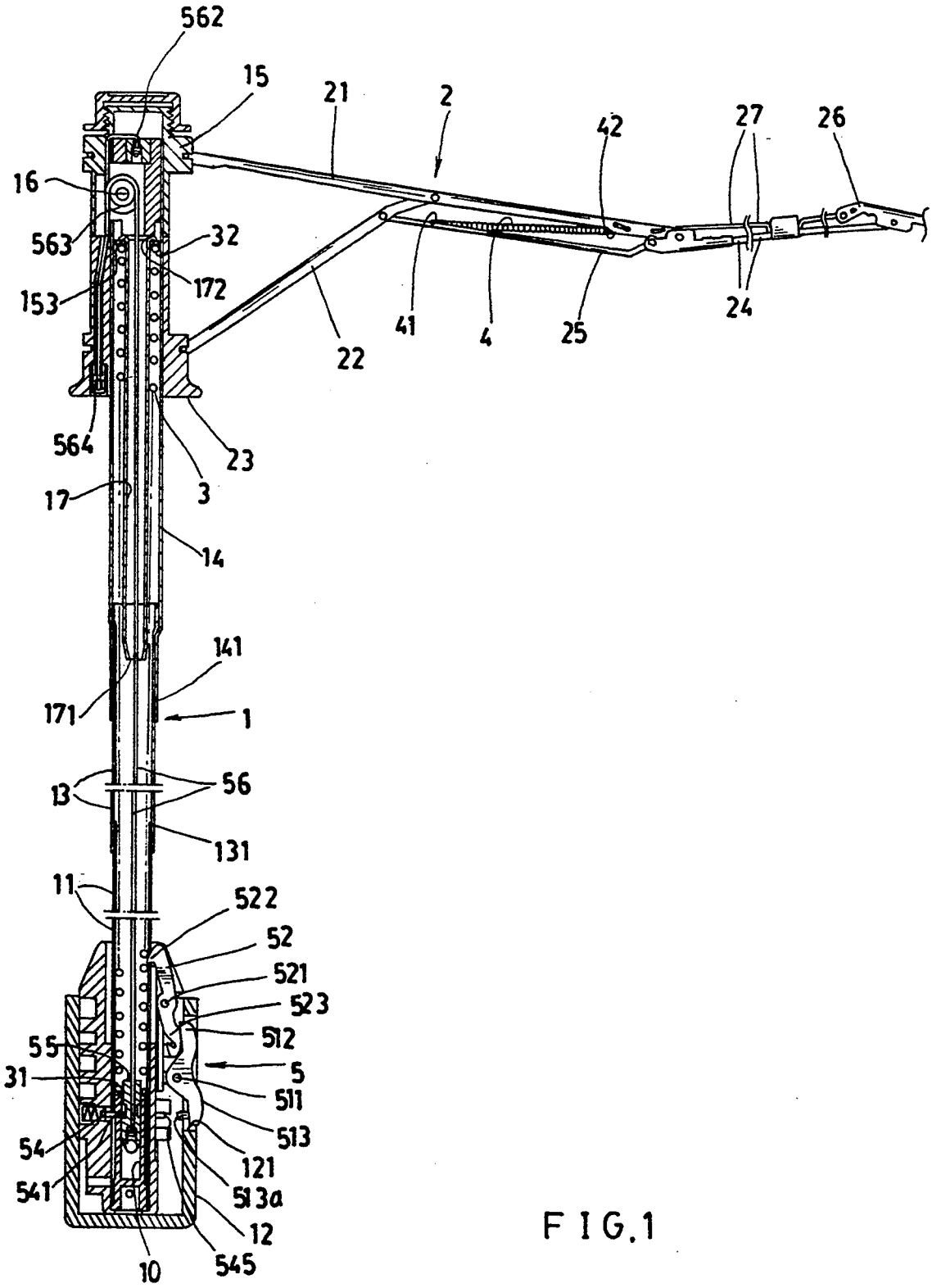
FIG. 1 is an illustration showing an opened umbrella in accordance with the present invention.

As shown in the drawing figures, the present invention comprises: a central shaft means 1, a rib assembly 2, an opening spring 3, a plurality of closing springs 4, and a control means 5.

The central shaft means 1 includes: an inner (or lower) tube 11, a grip 12 having a lower tube portion of the inner tube 11 fixed in a central portion of the grip 12, a lower sleeve 10 inserted in a central lower portion of the grip 12, a middle tube 13 slidably held on an outer and upper side of the inner tube 11, an outer (or upper) tube 14 slidably held on an outer and upper side of the middle tube 13, an upper notch 15 secured on a top portion of the outer tube 14, and an inner sleeve 17 having an upper sleeve portion of the inner sleeve 17 contiguous to an upper portion of the outer tube 14.

The rib assembly 2 includes: a top rib 21 having an inner rib portion of the top rib 21 pivotally secured to the upper notch 15 of the central shaft means 1, an inner stretcher rib 22 having an inner rib portion of the inner stretcher rib 22 pivotally secured to a lower runner 23 which is slidably held on the outer tube 14 and having an outermost rib end of the inner stretcher rib 22 pivotally connected with a middle portion of the top rib 21, an intermediate rib 24 having an inner rib end of the intermediate rib 24 pivotally connected with an outermost rib end of the top rib 21 and having an innermost rib end of the intermediate rib 24 pivotally connected with an intermediate connecting rod 25 of which an inner rod end of the intermediate connecting rod 25 is pivotally secured to an outer rib portion of the inner stretcher rib 22, and a rear rib 26 having an inner rib portion of the rear rib 26 pivotally connected with an outer rib portion of the intermediate rib 24 and having an innermost rib end of the rear rib 26 pivotally connected with a spring rod 27 of which an inner rod end of the spring rod 27 is pivotally connected with an outer rib portion of the top rib 21.

The opening spring 3 for opening an umbrella of this invention has a lower spring end 31 retained on an upper edge portion of the lower sleeve 10, and an upper spring end 32 retained on a retainer plate 153 secured to an inner block 151 inserted in an upper portion of the outer tube 15, the opening spring 3 slidably disposed about the inner sleeve 17.

Each closing spring 4 of the plurality of the closing springs 4 has an inner spring end 41 of the closing spring 4 secured to an outer rib portion of the inner stretcher rib 22, and an outer spring end 42 of the closing spring 4 secured to an outer rib portion of the top rib 21, the closing spring 4 having a spring portion disposed in a longitudinal groove recessed in the top rib 21 for operatively closing an umbrella from its opened state by an elastic energy stored when opening the umbrella.

The control means 5 includes: a seesaw button 51 pivotally mounted in the grip 12 by a button pivot 511, an opening lever 52 pivotally mounted in an upper portion of the grip 12 and operatively depressed by an upper button portion 512 of the seesaw button 51 for opening the umbrella, and a closing controller 53 operatively depressible by a lower button portion 513 of the seesaw button 51 for disengaging a locking head 55 secured with a drag rope 56, which is linked among the locking head 55, the lower runner 23 and an upper portion of the outer tube 14, from a sliding latch 54 slidably held in the grip 12, thereby allowing each said closing spring 4 to restore to release its pre-stored elastic energy for closing the umbrella from an opened state.

The opening lever 52 includes a lever pivot 521 for pivotally mounting the opening lever 52 in the grip 12, a hook portion 522 formed on an upper portion of the opening lever 52 engageable with a hook hole 141 formed in the outer tube 14, a hook hole 131 formed in the middle tube 13 and a hook hole 111 in the inner tube 11 for locking an umbrella under a closed state, and a depression portion 523 formed on a lower portion of the opening lever 52 and resiliently held by a lever spring 524 retained in the grip to be operatively depressed by the upper button portion 512 of the seesaw button 51 for disengaging the hook portion 522 from the hook holes 141, 131, 111 of the outer, middle and inner tubes 14, 13, 11 for opening the umbrella as resiliently tensioned by the opening spring 3.

Figure 6:
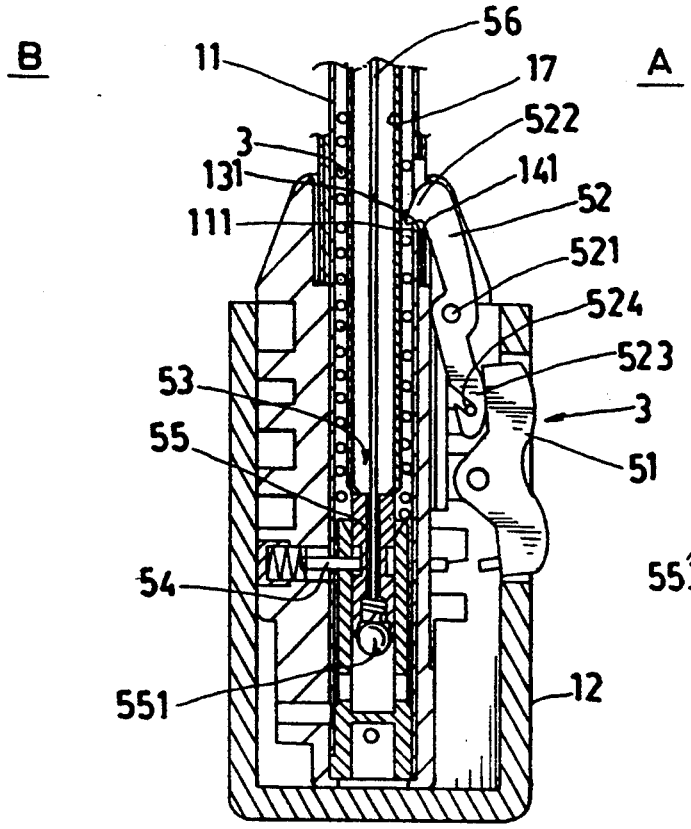
FIG. 6 is a sectional drawing of the control means and the grip of the present invention.
Figure 8:
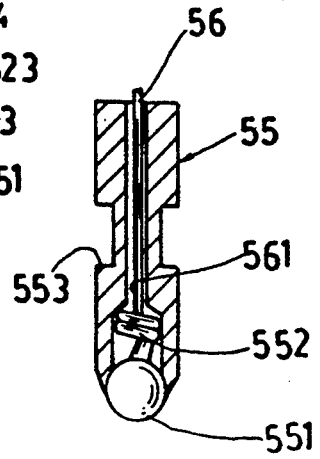
FIG. 8 shows a locking head of the control means of the present invention.
Figure 7:
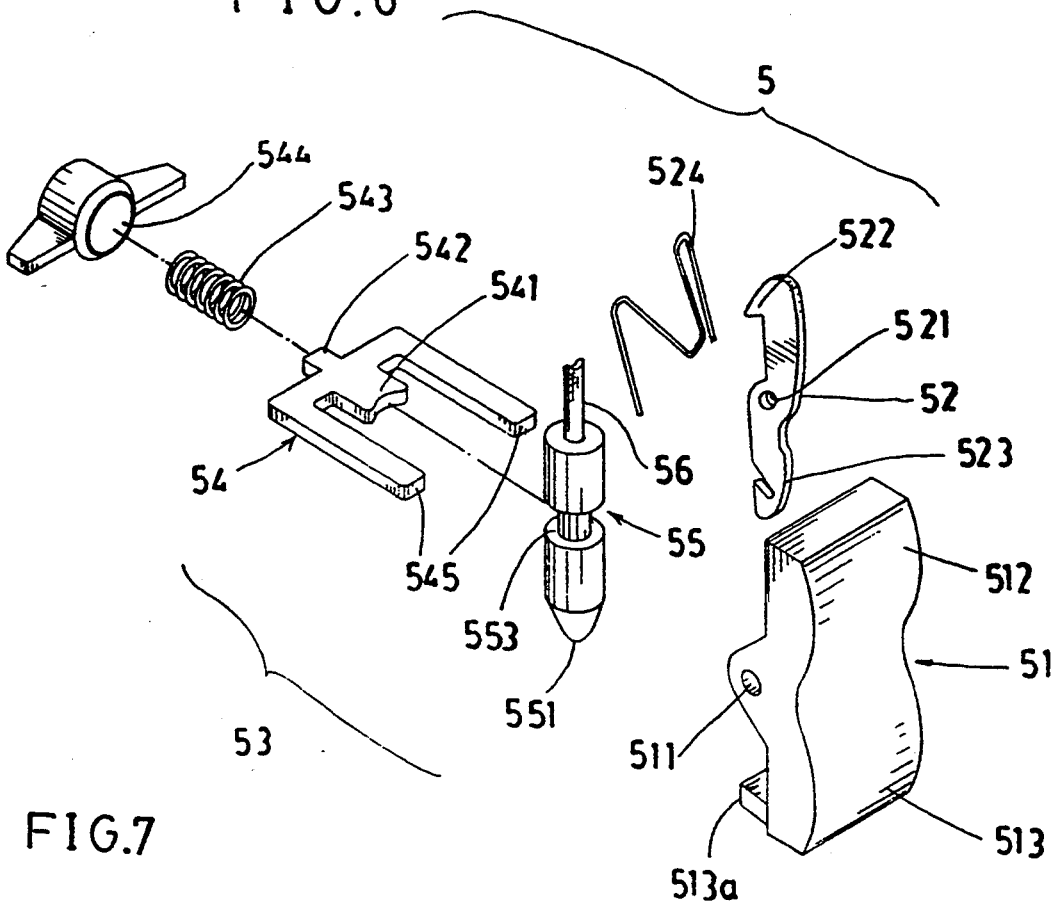
FIG. 7 is an exploded view showing the elements of the control means of the present invention.

The closing controller 53 as shown in FIGS. 6–8 includes: the sliding latch 54 having a tongue portion 541 engageable with the locking head 55 secured with the drag rope 56, a pair of arm members 545 bifurcated from the tongue portion 541 and protruding frontwardly towards a seesaw button 51 at a first side A of the central shaft means 1 to be operatively depressed by the lower button portion 513 of the seesaw button 51 for closing an umbrella from an opened state, a latch spring 543 jacketed on a stem 542 protruding rearwardly from the tongue portion 541 towards a second side B of the shaft means 1 to be resiliently retained on a plug 544 inserted in the grip 12 adjacent to the second side B of the shaft means 1 for normally urging the sliding latch 54 frontwardly to be operatively depressed by a pusher stem 513*a* formed inside the lower button portion 513 of the seesaw button 51.

The locking head 55 generally cylindrical shaped includes: a bottom ball 551 resiliently held in a bottom portion of the locking head 55 and secured to an inner retainer 552 formed in the locking head 55 with the inner retainer 552 also secured with a lower rope end 561 of the drag rope 56, an annular groove 553 circumferentially recessed in a middle section of the locking head 55 for engaging the tongue portion 541 of the sliding latch 54. The locking head 55 is downwardly rested on the lower sleeve 10 to be locked by the latch 54 as shown in FIG. 6.

The drag rope 56 includes: the lower rope end 561 secured to the locking head 55, an upper rope end 562 fixed to a top portion 152 of the outer tube 14 and in the upper notch 15, an upper guiding roller 563 rotatably mounted by a upper pivot 16 in the inner block 151 secured in a top portion of the outer tube 14 and in the upper notch 15 for slidably guiding an intermediate rope section of the drag rope 56 from inside the inner tube 11, the middle tube 13, the inner sleeve 17 and the outer tube 14 through the upper guiding roller 563 towards a lower guiding roller 564 through a rope passage 150 formed in the upper notch 15, the rope 56 with an upper rope section passing through the lower guiding roller 564 to have the upper rope end 562 fixed to the top portion 152 of the outer tube 14 and inside the inner block 151. The rope 56 provides a stroke for telescopically operating the tubes of the central shaft means 1 and the runner 23.

Figure 3:
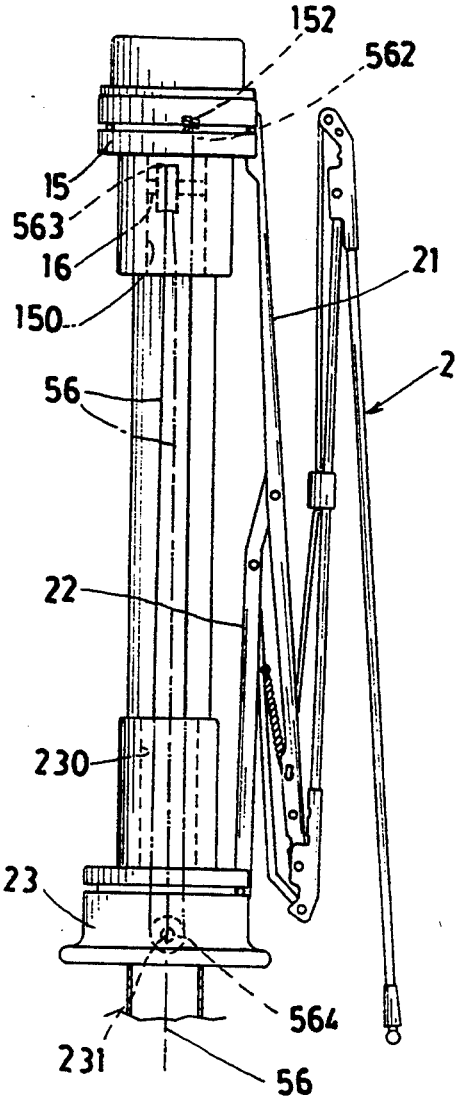
FIG. 3 is a partial illustration of the closed umbrella as shown in FIG. 2.
Figure 5:
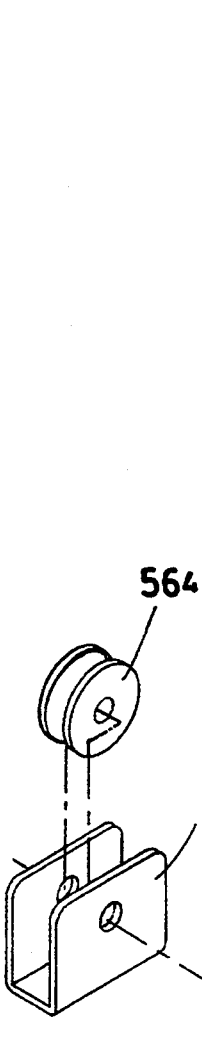
FIG. 5 shows a guiding roller for guiding a drag rope of the present invention.
Figure 4:
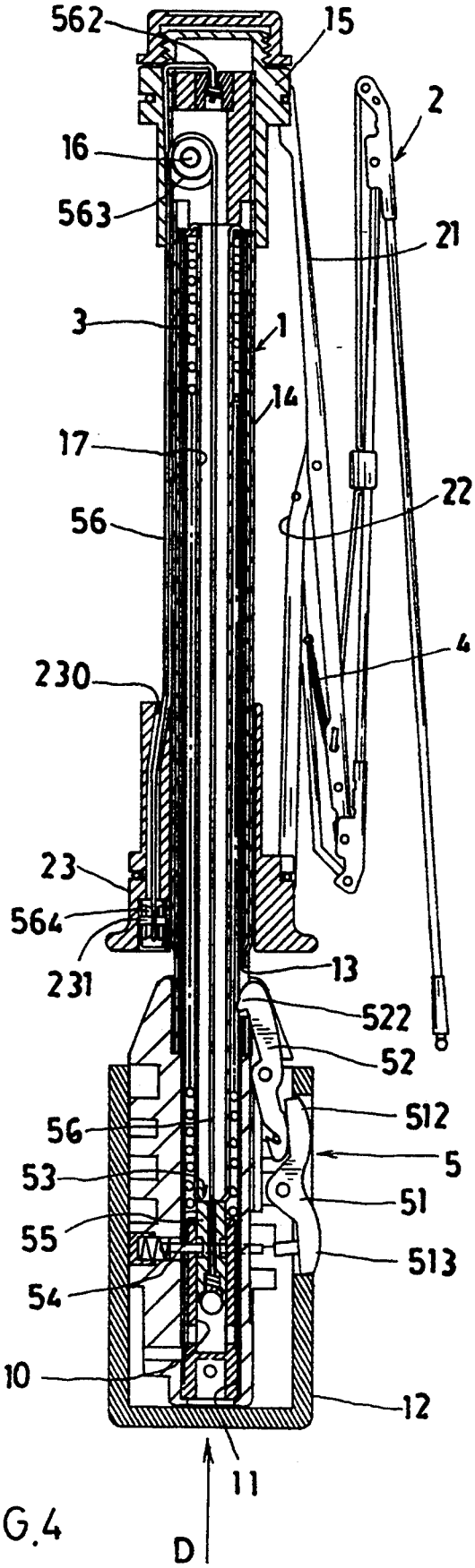
FIG. 4 shows a shortened folded umbrella after being re-set for pre-storing a spring energy of the umbrella ready for a next opening use.

The lower guiding roller 564 as shown in FIGS. 3–5 is rotatably mounted in a roller holder 232 embedded or fixed in the lower runner 23 by a lower pivot 231 for guiding a rope section of the drag rope 56 through a lower rope passage 230 formed in the lower runner 23. The lower guiding roller 564 may be integrally secured in a bottom recess in the lower runner 23 for a synchronous sliding operation with the sliding of the lower runner 23 on the shaft means 1 when opening and closing the umbrella.

When opening the umbrella of the present invention as shown in FIG. 1, the upper button portion 512 of the seesaw 51 is depressed to force the depression portion 523 of the opening lever 52 to bias and disengage the hook portion 522 from the hook holes formed in the tubes of the shaft means 1 to release the opening spring 3, which is previously compressed when re-setting the umbrella for storing the elastic energy of the opening spring as shown in FIG. 4, to extend the tubes 14, 13, 11 and open the ribs of the rib assembly 2 for opening the umbrella. The closing springs 4 are also tensioned to store their restoring elastic energy by the opening operation of the umbrella as effected by the opening spring 3.

Figure 2:
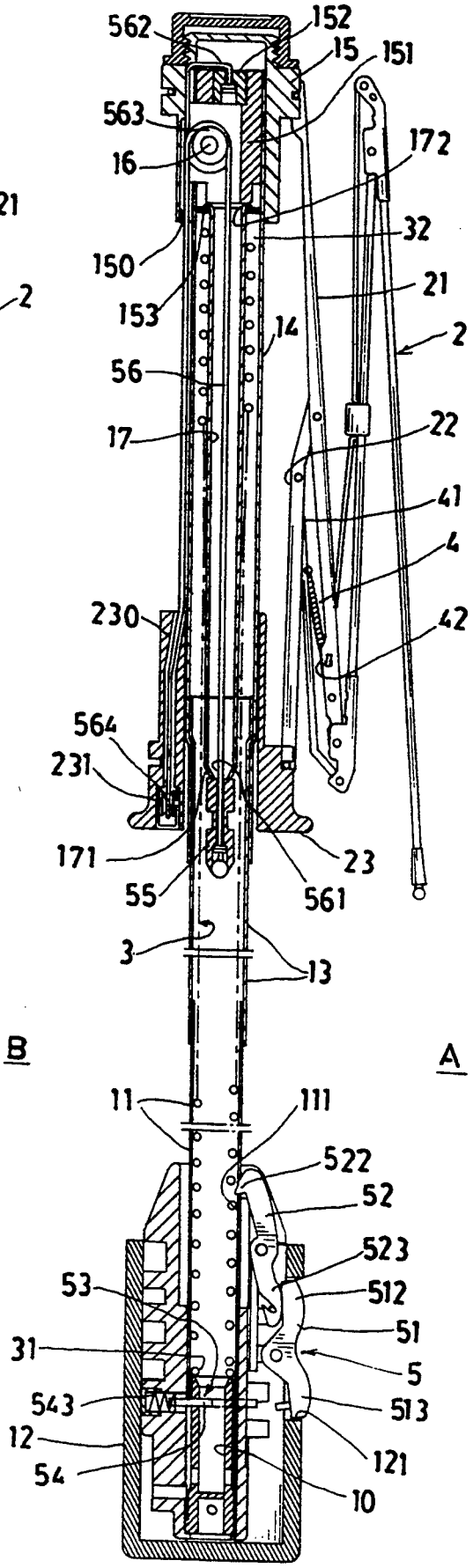
FIG. 2 is an illustration showing a closed umbrella of the present invention.

When closing the umbrella from FIG. 1 to FIG. 2, the lower button portion 513 of the seesaw button 51 is depressed to force the sliding latch 54 of the closing controller 53 rearwardly (towards the second side B of shaft means 1) to disengage the locking head 55 from the tongue portion 541 of the sliding latch 54 to allow a downward movement of the runner 23 required for closing the umbrella, and the closing springs 4 will restore to lower the runner 23 to retract the ribs of the rib assembly 2 and fold the tubes 14, 13, 11 as shown in FIG. 2. The locking head 55 will then be raised to be stopped at a lower sleeve portion 171 of the inner sleeve 17.

For re-setting the folded or closed umbrella to store an elastic energy of the opening spring 3, the grip 12 may be depressed (D) towards a tip portion of the umbrella for compressing the spring 3 ready for next opening use.

The present invention may be used for an automatic umbrella having triple folds or multiple folds, thereby greatly shortening a total length of a folded umbrella for convenient portable and storage purpose.

We claim:

1. An automatic umbrella comprising:

a central shaft means (1) including: an inner tube (11), a grip (12) having a lower tube portion of the inner tube (11) fixed in a central portion of the grip (12), a lower sleeve (10) inserted in a central lower portion of the grip (12), a middle tube (13) slidably held on an outer and upper side of the inner tube (11), an outer tube (14) slidably held on an outer and upper side of the middle tube (13), an upper notch (15) secured on a top portion of the outer tube (14), and an inner sleeve (17) having an upper sleeve portion of the inner sleeve (17) contiguous to an upper portion of the outer tube (14);

a rib assembly (2) including: a top rib (21) having an inner rib portion of the top rib (21) pivotally secured to the upper notch (15) of the central shaft means (1), an inner stretcher rib (22) having an inner rib portion of the inner stretcher rib (22) pivotally secured to a lower runner (23) which is slidably held on the outer tube (14) and having an outermost rib end of the inner stretcher rib (22) pivotally connected with a middle portion of the top rib (21), an intermediate rib (24) having an inner rib end of the intermediate rib (24) pivotally connected with an outermost rib end of the top rib (21) and having an innermost rib end of the intermediate rib (24) pivotally connected with an intermediate connecting rod (25) of which an inner rod end of the intermediate connecting rod (25) is pivotally secured to an outer rib portion of the inner stretcher rib (22), and a rear rib (26) having an inner rib portion of the rear rib (26) pivotally connected with an outer rib portion of the intermediate rib (24) and having an innermost rib end of the rear rib (26) pivotally connected with a spring rod (27) of which an inner rod end of the spring rod (27) is pivotally connected with an outer rib portion of the top rib (21);

an opening spring (3) for opening an umbrella having a lower spring end (31) retained on an upper edge portion of the lower sleeve (10), and an upper spring end (32) retained on a retainer plate (153) secured to an inner block (151) inserted in an upper portion of the outer tube (15), the opening spring (3) slidably disposed about the inner sleeve (17);

a plurality of closing springs (4) each said closing spring having an inner spring end (41) secured to an outer rib portion of the inner stretcher ribs (22), and an outer spring end (42) of the closing spring (4) secured to an outer rib portion of the top rib (21), the closing spring (4) having a spring portion disposed in a longitudinal groove recessed in the top rib (21) for operatively closing an umbrella from an opened state by an elastic energy stored when opening the umbrella; and a control means (5) including: a seesaw button (51) pivotally mounted in the grip (12) by a button pivot (511), an opening lever (52) pivotally mounted in an upper portion of the grip (12) and operatively depressed by an upper button portion (512) of the seesaw button (51) for opening the umbrella, and a closing controller (53) operatively depressible by a lower button portion (513) of the seesaw button (51) for disengaging a locking head (55) secured with a drag rope (56), which is linked among the locking head (55), the lower runner (23) and an upper portion of the outer tube (14), from a sliding latch (54) slidably held in the grip (12), thereby allowing each said closing spring (4) to restore to release its pre-stored elastic energy for closing the umbrella from an opened state.

2. An automatic umbrella according to claim 1, wherein said opening lever (52) includes a lever pivot (521) for pivotally mounting the opening lever (52) in the grip (12), a hook portion (522) formed on an upper portion of the opening lever (52) engageable with a hook hole (141) formed in the outer tube (14), a hook hole (131) formed in the middle tube (13) and a hook hole (111) in the inner tube (11) for locking an umbrella under a closed state, and a depression portion (523) formed on a lower portion of the opening lever (52) and resiliently held by a lever spring (524) retained in the grip to be operatively depressed by the upper button portion (512) of the seesaw button (51) for disengaging the hook portion (522) from the hook holes (141, 131, 111) of the outer, middle and inner tubes (14, 13, 11) for opening the umbrella as resiliently tensioned by the opening spring (3).

3. An automatic umbrella according to claim 1, wherein said closing controller (53) includes: the sliding latch (54) having a tongue portion (541) engageable with the locking head (55) secured with the drag rope (56), a pair of arm members (545) bifurcated from the tongue portion (541) and protruding frontwardly towards a seesaw button (51) at a first side (A) of the central shaft means (1) to be operatively depressed by the lower button portion (513) of the seesaw button (51) for closing an umbrella from an opened state, a latch spring (543) jacketed on a stem (542) protruding rearwardly from the tongue portion (541) towards a second side (B) of the shaft means (1) to be resiliently retained on a plug (544) inserted in the grip (12) adjacent to the second side (B) of the shaft means (1) for normally urging the sliding latch (54) frontwardly to be operatively depressed by a pusher stem (513*a*) formed inside the lower button portion (513) of the seesaw button (51).

4. An automatic umbrella according to claim 3, wherein said locking head (55) generally cylindrical shaped includes: a bottom ball (551) resiliently held in a bottom portion of the locking head (55) and secured to an inner retainer (552) formed in the locking head (55) with the inner retainer (552) secured with a lower rope end (561) of the drag rope (56), an annular groove (553) circumferentially recessed in a middle section of the locking head (55) for engaging the tongue portion (541) of the sliding latch (54).

5. An automatic umbrella according to claim 4, wherein said drag rope (56) includes: the lower rope end (561) secured to the locking head (55), an upper rope end (562) fixed to a top portion (152) of the outer tube (14) and in the upper notch (15), an upper guiding roller (563) rotatably mounted by a upper pivot (16) in the inner block (151) secured in a top portion of the outer tube (14) and in the upper notch (15) for slidably guiding the drag rope (56) from inside the inner tube (11), the middle tube (13), the inner sleeve (17), and the outer tube (14) towards a lower guiding roller (564) through a rope passage (150) formed in the upper notch (15), the rope (56) with an upper rope section passing through the lower guiding roller (564) to have the upper rope end (562) fixed to the top portion (152) of the outer tube (14) and inside the inner block (151).

6. An automatic umbrella according to claim 5, wherein said lower guiding roller (564) is rotatably mounted in a roller holder (232) fixed in the lower runner (23) by a lower pivot (231) for guiding the drag rope (56) through a lower rope passage (230) formed in the lower runner (23).

* * * * *